US008816177B2

(12) United States Patent
Goto

(10) Patent No.: US 8,816,177 B2
(45) Date of Patent: Aug. 26, 2014

(54) BRIDGE FOR STRING INSTRUMENT, SADDLE FOR STRING INSTRUMENT, AND STRING INSTRUMENT THEREWITH

(71) Applicant: Gotoh Gut Co., Ltd., Gunma (JP)

(72) Inventor: Masaki Goto, Gunma (JP)

(73) Assignee: Gotoh Gut Co., Ltd. (JP)

( * ) Notice: Subject to any disclaimer, the term of this patent is extended or adjusted under 35 U.S.C. 154(b) by 0 days.

(21) Appl. No.: 13/660,080

(22) Filed: Oct. 25, 2012

(65) Prior Publication Data

US 2014/0053705 A1 Feb. 27, 2014

(30) Foreign Application Priority Data

Aug. 22, 2012 (JP) ..... 2012-183022

(51) Int. Cl.
*G10D 3/04* (2006.01)

(52) U.S. Cl.
USPC ..... 84/307; 84/298

(58) Field of Classification Search
USPC ..... 84/307
See application file for complete search history.

(56) References Cited

U.S. PATENT DOCUMENTS 4,031,799 A * 6/1977 Fender ..... 84/307
4,281,576 A * 8/1981 Fender ..... 84/298
4,361,068 A * 11/1982 Schaller ..... 84/299
4,541,320 A * 9/1985 Sciuto ..... 84/298
4,632,005 A * 12/1986 Steinberger ..... 84/313
4,867,031 A * 9/1989 Fender ..... 84/313
5,208,410 A * 5/1993 Foley ..... 84/307
5,277,094 A * 1/1994 Spuler ..... 84/298
5,347,905 A * 9/1994 Cipriani ..... 84/298
6,133,515 A * 10/2000 Hoshino ..... 84/307
7,301,086 B2 * 11/2007 Ito ..... 84/299
7,365,255 B1 * 4/2008 Piskulic et al. ..... 84/298
2010/0275756 A1 * 11/2010 Woodland et al. ..... 84/307
2010/0319514 A1 * 12/2010 Aires ..... 84/298
2011/0259171 A1 * 10/2011 Babicz ..... 84/298

FOREIGN PATENT DOCUMENTS

JP 2011-197618 10/2011

* cited by examiner

*Primary Examiner* — Christopher Uhlir
(74) *Attorney, Agent, or Firm* — Thompson Hine L.L.P.

(57) ABSTRACT

A bridge for a string instrument, which has a simple structure and is easily processed, is provided, whereby the material cost of the saddle is decreased and superior vibrancy of sound is provided. The bridge has a saddle body 50 that is formed with string grooves 55 at two ends thereof. The string groove 55 has a uniform portion 56 and deep groove portions 57. The deep groove portion 57 is formed into an arc shape in cross section and has a larger curvature radius than that of the uniform portion 56. The uniform portion 56 and the deep groove portion 57 cross with each other at a predetermined portion, and the vicinity of the predetermined portion has a chevron shape in vertical cross section. The chevron shapes of the deep groove portions 57 have peaks P that are arranged at different position in the circumferential direction.

7 Claims, 4 Drawing Sheets

BRIDGE FOR STRING INSTRUMENT, SADDLE FOR STRING INSTRUMENT, AND STRING INSTRUMENT THEREWITH

BACKGROUND OF THE INVENTION

1. Technical Field

The present invention relates to a bridge for tuning octaves of strings of a string instrument, and in particular, the present invention relates to a technique for improving vibrancy of musical sound with a saddle having a simple structure.

2. Background Art

For example, a string instrument such as a guitar has a neck and a body that is provided with a bridge. The neck includes a head that is provided with pegs and includes a nut at an end portion thereof, and the bridge is provided with saddles. Ends of plural strings are anchored to the bridge, and the other ends of the strings are wound to the pegs. In this structure, a distance between the nut and the saddles is a scale length. In such string instruments, tuning is performed by adjusting tensions of the strings with the pegs.

In string instruments with frets, such as guitars, there are cases of off-pitch when a player holds down strings for performance. This is because a distance from a saddle to each fret is not suitably adjusted. Therefore, it is necessary to finely adjust the position of the saddle, that is, the scale length, with respect to each string. This adjustment is called "octave tuning".

For example, in a folk guitar or the like, the scale length of each string is set at a most appropriate value by obliquely fixing a plate-like saddle on a bridge. On the other hand, some electric guitars have plural saddles that are separately arranged with respect to each string, and the saddles are movable by screws so as to separately tune the octaves of each string. In general, such a bridge is used in most electric guitars.

On the other hand, other kinds of electric guitars do not have saddles that are movable with respect to each string. For example, in a famous series of electric guitar called a "Telecaster" (registered trademark of Fender Musical Instruments Corporation), a bridge includes saddles that are made so as to support two strings at two ends of each saddle. This structure is fixed as a conventional design, and it provides brilliant sound that is highly regarded by musicians. Therefore, it has been difficult to modify the structure so as to separately tune each string. Accordingly, a technique for separately tuning the octaves of each string even in such a bridge is desired.

A bridge is disclosed in Japanese Unexamined Patent Application Laid-open No. 2011-197618. This bridge is formed with approximately columnar-shape saddles and rotatably supports screws at an edge portion of the plate thereof. The screws penetrate through the center portions of the saddles so that the saddles are movable. Each of the saddles is formed with a string groove at two ends for supporting a string, and the ends are eccentrically arranged at a nut side and the other side, respectively. In the saddle of such a bridge, for example, a supporting point of a first string is closer to the nut than a supporting point of a second string, whereby the scale length of the first string is shorter. The distance between the supporting points in the saddle is set so that the octave of the other string is simultaneously tuned by tuning the octave of one of the first string and the second string. The saddle for third and fourth strings and the saddle for fifth and sixth strings have the same structure as described above, whereby the octaves of all of the first to the sixth strings can be tuned.

In the bridge disclosed in Japanese Unexamined Patent Application Laid-open No. 2011-197618, each of the saddles is formed into a columnar shape in which the two ends thereof are eccentrically arranged at the nut side and the other side, respectively, with respect to the center portion of the saddle. In order to produce such a saddle, after a columnar metal material is turned, two ends must be cut so as to be eccentrically arranged with respect to the center portion. Therefore, the production process is complicated, and large amounts of material are removed in the cutting, whereby the material cost is relatively high. In addition, a portion of the saddle for supporting a string is thin due to the cutting, whereby vibrancy of sound is not superior. Moreover, since the string grooves are formed along the outer circumferences of the columnar ends, the string grooves have an arc-like cross sectional shape. Accordingly, the string grooves have a large area for contacting the string, whereby vibrancy of sound is further degraded, and chattering noise occurs in some cases.

SUMMARY OF THE INVENTION

The present invention has been completed in view of the above circumstances. An object of the present invention is to provide a bridge for a string instrument, which has a simple structure and is easily processed, and by which the material cost of saddles is decreased and superior vibrancy of sound is provided.

The present invention provides a bridge for a string instrument having a body and strings that are stretched from an upper side to a bottom side of the body. The bridge includes a base, screw members, and saddles. The base is made so as to be mounted to the body of the string instrument and has an edge portion at a bottom thereof. Each of the screw members has a neck portion that is rotatably supported at the edge portion of the base. The saddles are screwed with the screw members and are movable toward the upper side or the bottom, side by turn of the screw members. Each of the saddles has a saddle body and string grooves. The saddle body has an approximately columnar shape and has an axis line that is made so as to approximately orthogonally cross the direction from the upper side to the bottom side. The string grooves extend along the circumferential direction at the outer circumferences of two ends of the saddle body, respectively. Each of the string groove has deep groove portions, and each of the deep groove portions has an approximately arc shape in cross section and has a larger curvature radius than that of the string groove in vertical cross section. Therefore, each of the deep groove portions has a chevron shape in the vicinity of a starting point thereof in vertical cross section. The peak of the chevron shape of the deep groove portion of one of the string grooves is closer to the upper side than the axis line in top view, and the peak of the chevron shape of the deep groove portion of the other string groove is closer to the bottom side than the axis line in top view.

According to the bridge having the above-described structure, by providing the deep groove portions to the string grooves, the peaks of the chevron shapes are arranged at different positions in the direction from the upper side to the bottom side. In this case, the distance between the peak of the chevron shape and the nut is a scale length. The peak of the chevron shape in one string groove and the peak of the chevron shape in the other string groove are arranged at different positions so as to simultaneously tune octaves of one string only by moving the saddle toward the upper side or the bottom side and tuning octaves of the other string.

In the present invention, the saddle has a structure such that the deep groove portions are provided to the string grooves, whereby the structure is simple and is obtained by an easy process. For example, the deep groove portions may be formed by rotatably supporting the saddle body and cutting grooves while changing the cutting amount with a cutting tool such as a ball end mill. Since the deep groove portions have an approximately arc shape in cross section, a smaller amount of the material is removed, and the volume of the saddle is larger, compared with a case of forming deep groove portions with a straight shape in cross section. Therefore, the material cost is decreased, and vibrancy of sound is improved. Moreover, the string is to be supported at the peak of the chevron shape, whereby the string has a small area for contacting the string groove. Accordingly, the vibrancy of sound is further improved.

It is desirable to provide two deep groove portions in the vertical cross section and to symmetrically arrange the peaks of the chevron shapes with respect to a straight line in the direction from the upper side to the bottom side. According to this structure, by mounting the saddle to the bridge upside down, a right-handed string instrument is changed into a left-handed string instrument.

Specifically, in a case of a string instrument with six strings, such as electric guitars, a saddle for first and second strings is arranged at the position of a saddle for fifth and sixth strings by being turned upside down. In addition, the saddle for the fifth and sixth strings is arranged at the position of the saddle for the first and second strings by being turned upside down. Moreover, a saddle for third and fourth strings is arranged at the same position by being turned upside down. Then, the first to the sixth strings are stretched in reverse order, whereby a left-handed string instrument is obtained.

In a case of a string instrument with four strings, such as electric basses, a saddle for first and second strings is arranged at the position of a saddle for third and fourth strings by being turned upside down. In addition, the saddle for the third and fourth strings is arranged at the position of the saddle for the first and second strings by being turned upside down. Then, the first to the fourth strings are stretched in reverse order, whereby a left-handed string instrument is obtained.

In the bridge of the present invention, the string groove desirably has a uniform portion with a constant depth. In this case, it is desirable that the two deep groove portions extend from the uniform portion and communicate with each other at a position that has the same depth as that of the uniform portion. In this structure, the saddle desirably has a diameter of 7 to 10 mm, and the deep groove portions desirably have a curvature radius of 5 to 8 mm.

If the curvature radius of the deep groove portion is less than 5 mm, it is close to the curvature radius of the string groove, whereby the vibrancy of sound is degraded. On the other hand, if the curvature radius of the deep groove portion is greater than 8 mm, the deep groove portion has a cross section that is close to a straight line, whereby the volume of the saddle is insufficient, and the vibrancy of sound is degraded.

The present invention also provides a saddle for a string instrument, and the saddle includes a saddle body, string grooves, a position adjustment screw hole, and height adjustment screw holes. The saddle body has an approximately columnar shape and has a center portion and two ends. The string grooves extend along the circumferential direction at the outer circumferences of the two ends of the saddle body. The position adjustment screw hole is provided at the center portion of the saddle body and orthogonally crosses an axis line of the saddle body. The height adjustment screw holes are provided by passing through the two ends of the saddle body, respectively, and they cross the position adjustment screw hole in side view. Each of the string grooves has deep groove portions, and each of the deep groove portions has an approximately arc shape in cross section and has a larger curvature radius than that of the string groove in vertical cross section. Therefore, each of the deep groove portions has a chevron shape in the vicinity of a starting point thereof in vertical cross section. The chevron shapes of the deep groove portions are arranged in a direction in which the height adjustment screw hole passes through. The peak of the chevron shape of the deep groove portion of one of the string grooves and the peak of the chevron shape of the deep groove portion of the other string groove are arranged at different positions in the circumferential direction. The saddle with such a structure has the same effects as those of the bridge of the present invention.

According to the present invention, a bridge having a simple structure is provided by an easy process, by which the material cost of saddles is decreased and superior vibrancy of sound is provided.

BRIEF DESCRIPTION OF DRAWINGS

FIG. 4A is a side sectional view, FIG. 4B is a cross section taken along line B-B in FIG. 4A, and FIG. 4C is a cross section taken along line C-C in FIG. 4A.

FIG. 5A is a side view of the saddle that is rotated by 90 degrees, and FIG. 5B is a view that is viewed from the arrow B in FIG. 5A.

PREFERRED EMBODIMENTS OF THE INVENTION

An embodiment of the present invention will be described with reference to figures hereinafter.

Figure 1:
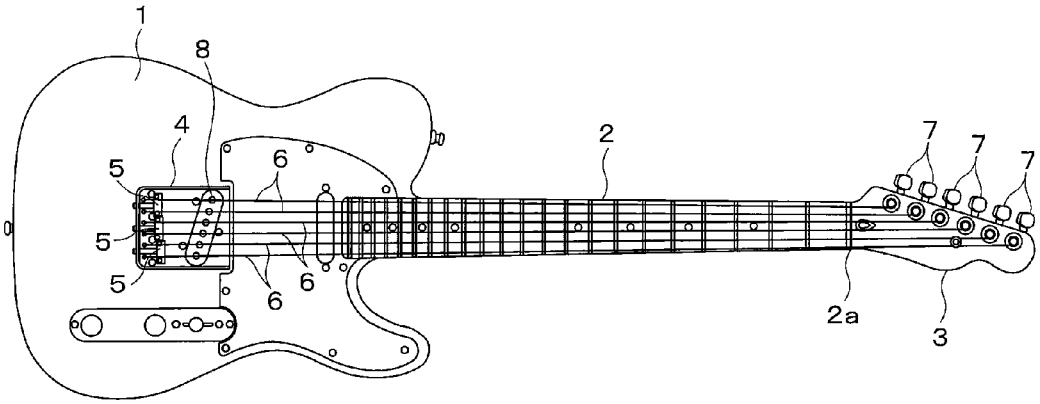
FIG. 1 is a top view of an electric guitar of an embodiment of the present invention.

FIG. 1 is a top view of an electric guitar of an embodiment in which the present invention is applied to the electric guitar of a Telecaster (registered trademark of Fender Musical Instruments Corporation) type. The guitar has a guitar body (body) 1 to which a neck 2 is fixed. The neck 2 has a head 3 at an end portion to which a nut 2*a* is fixed. In addition, the guitar body 1 is mounted with a bridge 4. It should be noted that the side of the head 3 is an upper side, and the other side is a bottom side, in the cases of indicating the direction in the following descriptions.

The bridge 4 is mounted with plural (three pieces in this embodiment) of saddles 5, and the saddles 5 support strings 6. The head 3 is mounted with pegs 7 that are wound with end portions of the strings 6. The reference numeral 8 in FIG. 1 denotes a pickup.

The structure of the bridge 4 will be described in detail. The reference numeral 40 in FIG. 2 denotes a base. The base 40 is formed by pressing a metal material such as brass and has a rectangular bottom plate 41 and side plates 42*a*, 42*b*, and 42*c* that stand from edge portions at three sides of the bottom plate 41. The bottom plate 41 has an end portion on the bottom side, and the end portion is formed with holes 43 at positions corresponding to the strings 6. The guitar body 1 is also formed with holes at the same positions as those of the holes 43. Thus, each string 6 is passed from a back surface of the guitar body 1 through the hole 43 and is wound to the peg 7 by anchoring a ball that is provided to the end portion of the string 6. The reference numeral 44 in FIG. 2 denotes an opening, and the pickups 8 are accommodated into the opening, whereby the base 40 is mounted to the guitar body 1. The reference numeral 45 denotes a screw, and the base 40 is mounted to the guitar body 1 with the screws 45.

FIGS. 4A to 6 are views that show details of the saddle 5. The reference numeral 50 in these figures denotes a saddle body. The saddle body 50 is made of metal such as brass and has a columnar shape and a center portion. The center portion is formed with a screw hole (position adjustment screw hole) 51 that penetrates from one side to the other side and that orthogonally crosses the axis line. The saddle body 50 also has screw holes (height adjustment screw holes) 52 at two sides. The screw holes 52 penetrate from one side to the other side and are formed at positions that are different from the position of the screw hole 51 by 90 degrees.

Figure 2:
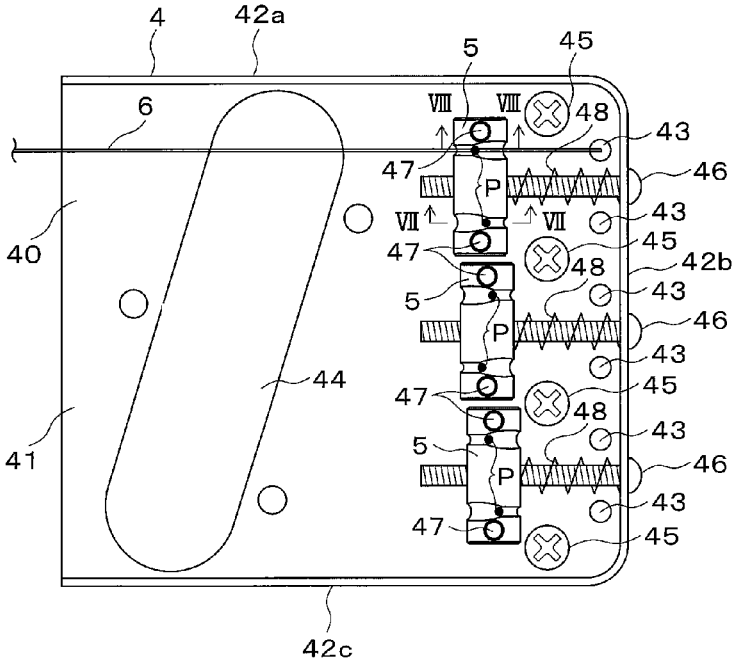
FIG. 2 is a top view of a bridge of an embodiment of the present invention.
Figure 3:
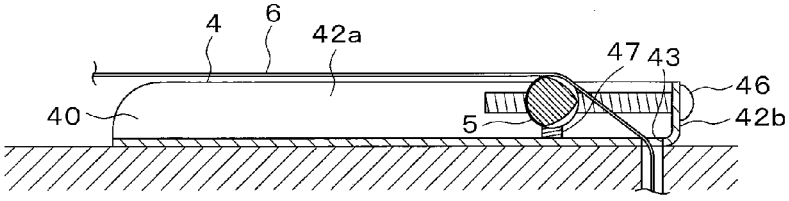
FIG. 3 is a side sectional view of a bridge of an embodiment of the present invention.

As shown in FIGS. 2 and 3, the side plate 42*b* of the base 40 rotatably supports screws (screw members) 46. Each screw 46 has an end portion that is screwed into the screw hole 51 of the saddle 5. A coil spring 48 is placed between the saddle 5 and the side plate 42*b*. According to this structure, the saddle 5 is biased toward the upper side by the coil spring 48 and is movable to the upper side by turning the screw 46, for example, in a counter-clockwise direction. Similarly, the saddle 5 is movable to the bottom side by turning the screw 46, for example, in a clockwise direction.

The screw holes 52 of the saddle 5 are screwed with screws 47 by protruding lower end portions of the screws 47. Each screw 47 is formed with a hexagonal hole (not shown in figures) at an upper end surface thereof and is turnable by putting a wrench into the hexagonal hole. By adjusting the projecting amount of the screw 47, the height of the saddle 5, that is, the string height is adjusted.

The details of the saddle 5 will be described with reference to FIGS. 4A to 6 as follows. As shown in FIGS. 4A to 6, the saddle body 50 is formed with a string groove 55 at the entirety of the outer circumference of the two ends thereof. The string groove 55 is formed of a uniform portion 56 with a constant depth and deep groove portions 57 with a larger depth than that of the uniform portion 56. Each deep groove portion 57 is formed into an arc shape in cross section and has a larger curvature radius than that of the uniform portion 56. The uniform portion 56 and the deep groove portion 57 cross with each other at a predetermined portion. The vicinity of the predetermined portion has a chevron shape in vertical cross section and is formed with a peak P of the chevron shape. The peak P is formed into an arc shape in cross section and has a curvature radius of 0.5 to 1.5 mm.

Figure 4B:
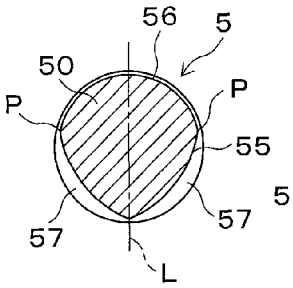
FIGS. 4A to 4C show a saddle of an embodiment of the present invention.
Figure 4A:
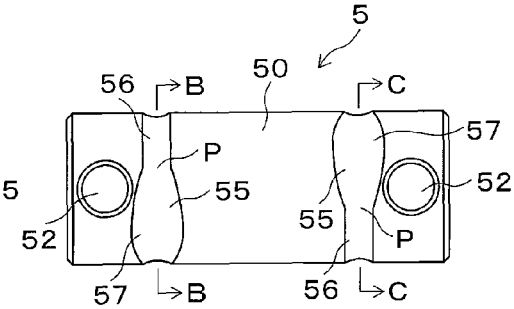
Figure 4C:
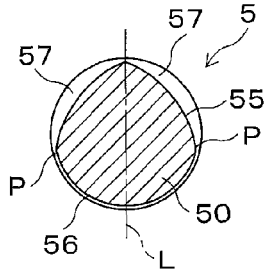
Figure 5A:
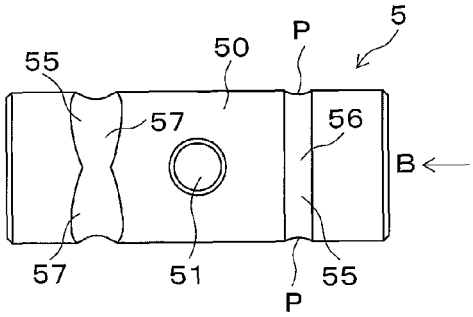
FIGS. 5A and 5B show the saddle shown in FIG. 4A.
Figure 5B:
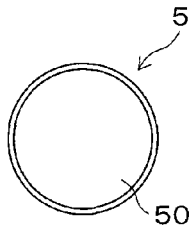
Figure 6:
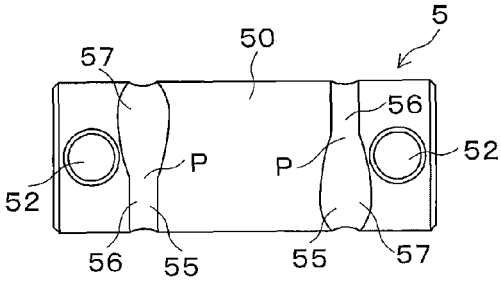
FIG. 6 is a side view of the saddle that is shown in FIG. 5A and is rotated by 90 degrees.

As shown in FIGS. 4B and 4C, the pair of the deep groove portions 57 including the peaks P of the string groove 55 is symmetrically formed with respect to a line L that extends from the upper side to the bottom side in vertical cross section. On the other hand, the pair of the deep groove portions 57 including the peaks P of the other string groove 55 is also symmetrically formed with respect to a line L that extends from the upper side to the bottom side in vertical cross section. In this case, the position of the former pair of the deep groove portions 57 differs from the position of the latter pair of the deep groove portions 57 by 180 degrees. The two deep groove portions 57 of the string groove 55 extend from the uniform portion 56 and communicate with each other at a position that has the same depth as that of the uniform portion 56. In this structure, the saddle has a diameter of 7 to 10 mm, and the deep groove portions 57 have a curvature radius of 5 to 8 mm.

Figure 7:
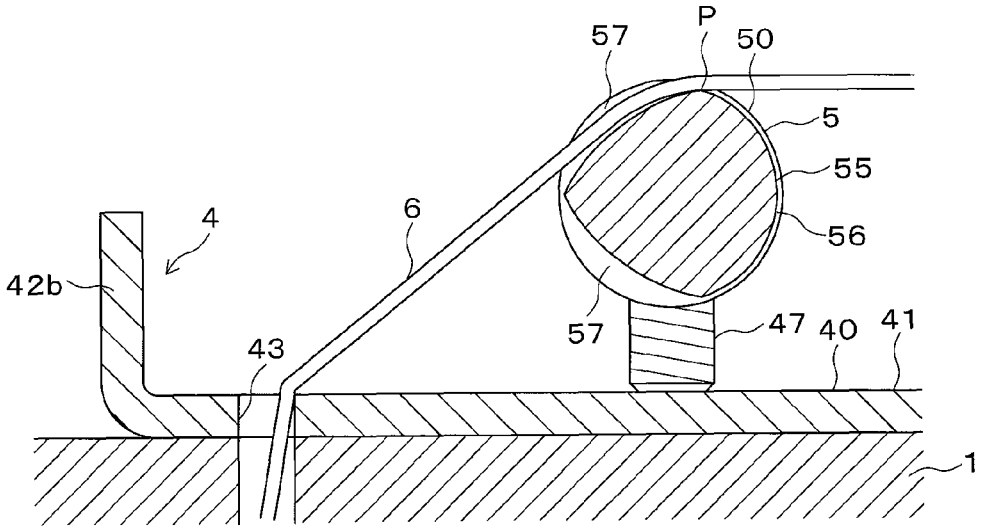
FIG. 7 is an enlarged view of a cross section taken along line VIII-VIII in FIG. 2.
Figure 8:
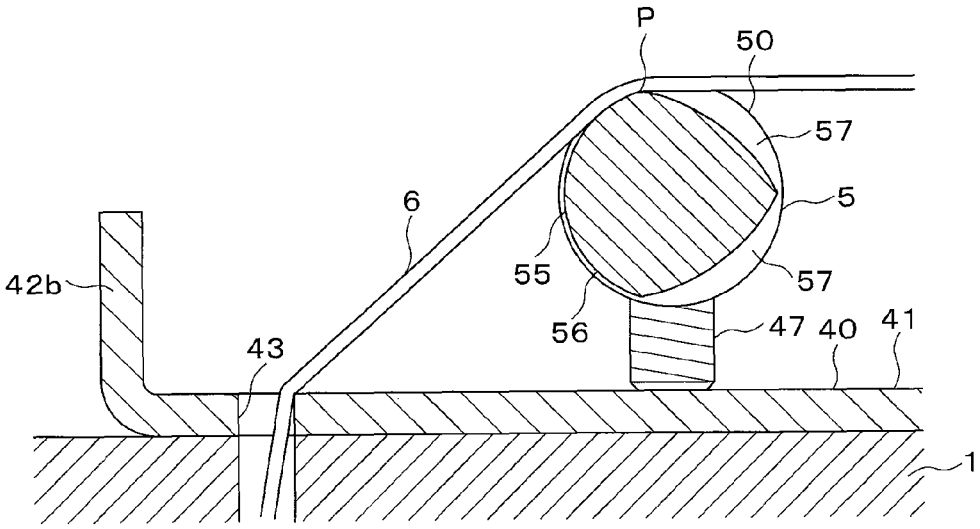
FIG. 8 is an enlarged view of a cross section taken along line VII-VII in FIG. 2.

Next, the function and the effects of the bridge 4 having the above structure will be described with reference to FIGS. 7 to 9. FIG. 7 is a cross section of a saddle 5 for a first string, and FIG. 8 is a cross section of a saddle 5 for a second string. As shown in FIGS. 7 and 8, the string 6 is supported by the string groove 55, but a part of the string 6 is free from the peak P to the bottom side. Therefore, the distance from the peak P to the nut 2*a* is a scale length, and octave tuning is performed by turning the screw 46 and moving the saddle 5 to the upper side or the bottom side. The peak P of one string groove 55 and the peak P of the other string groove 55 are arranged at different positions in the direction from the upper side to the bottom side so as to simultaneously tune the octaves of the second string (or the first string) by tuning the octaves of the first string (or the second string).

Figure 9:
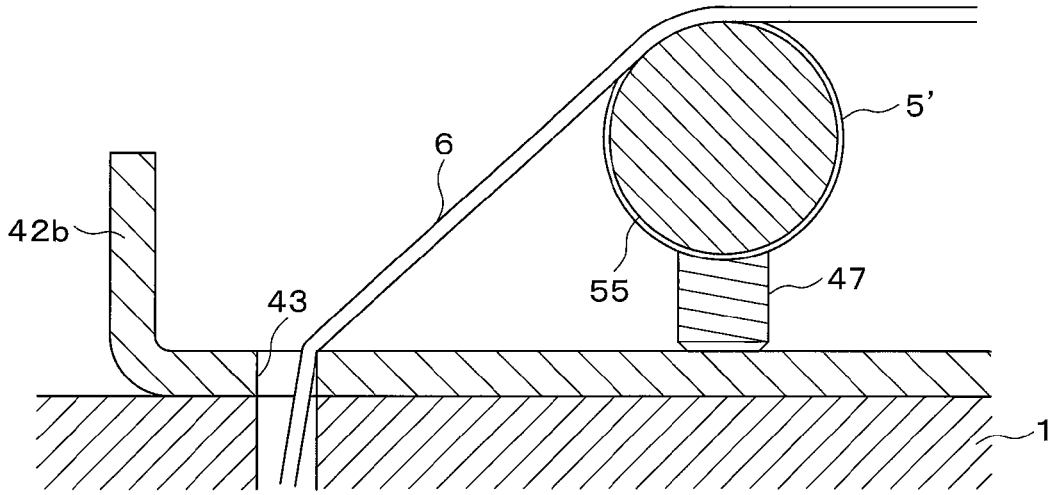
FIG. 9 is a cross section of a conventional saddle.

FIG. 9 is a cross section of a saddle 5' having string grooves 55 without deep groove portions 57. As shown in FIG. 9, a large portion of the string 6 contacts the string groove 55. Therefore, vibrancy of sound is not superior, and there may be cases in which chattering noise occurs due to wear of the string groove 55 and the like. In contrast, in the embodiment of the present invention, since a part of the string 6 is free from the peak P to the bottom side, the string 6 has a smaller area for contacting the string groove 55, whereby the vibrancy of sound is improved.

In the embodiment of the present invention, the saddle has a structure in which the deep groove portions 57 are formed at the string grooves 55, whereby the structure is simple and is obtained by easy process. In this embodiment, the uniform portion 56 may be formed by cutting with a ball end mill while rotating the saddle body 50. Then, the deep groove portion 57 may be formed such that the cutting depth of the ball end mill is gradually increased and is then gradually decreased to the depth corresponding to the depth of the uniform portion 56. Since the deep groove portions 57 have an arc shape in cross section, a small amount of material is removed, and the volume of the saddle is larger, compared with a case of forming deep groove portions 57 with a straight shape in cross section. Accordingly, the material cost is decreased, and the vibrancy of sound is further improved.

The electric guitar shown in FIG. 1 is made for playing with the right hand, and first to sixth strings are stretched from the lower side in FIG. 1 in that order. In order to change this electric guitar so as to play with the left hand, the first to six strings must be stretched from the lower side in FIG. 1 in reverse order. In this case, since each saddle 5 is made so as to tune the octaves of each predetermined string, the position of each saddle 5 must be changed according to the change of the positions of the strings.

In this regard, the saddle 5 for the first and second strings is arranged at the position of the saddle 5 for the fifth and sixth strings by being turned upside down. In addition, the saddle 5 for the fifth and sixth strings is arranged at the position of the saddle 5 for first and second strings by being turned upside down. The saddle 5 for the third and fourth strings remains at the same position by being turned upside down. Then, the first to sixth strings are stretched in reverse order, whereby a left-handed electric guitar is obtained.

The present invention is applied to the electric guitar in this embodiment but can be applied to various string instruments such as electric basses, acoustic guitars, or the like.

The present invention can be applied to string instruments such as electric guitars or the like as a bridge by which the octave tuning is performed.

What is claimed is:

1. A bridge for a string instrument having a body and strings that are stretched from an upper side to a bottom side of the body, the bridge comprising:

a base made so as to be mounted to the body of the string instrument and having an edge portion at a bottom thereof;

screw members having a neck portion that is rotatably supported at the edge portion of the base; and saddles screwed with the screw members and being movable toward the upper side or the bottom side by turn of the screw members, wherein each of the saddles has a saddle body and string grooves, the saddle body has an approximately columnar shape and has an axis line that is made so as to approximately orthogonally cross a direction from the upper side to the bottom side, the string grooves extend along a circumferential direction at an outer circumference of two ends of the saddle body, respectively, and wherein each of the string grooves has deep groove portions, each of the deep groove portions has an approximately arc shape in cross section and has a larger curvature radius than that of the string groove in vertical cross section, whereby each of the deep groove portions has a chevron shape in the vicinity of a starting point thereof in vertical cross section, the chevron shape of a deep groove portion of one of the string grooves has a peak, which is closer to the upper side than the axis line in top view, and the chevron shape of another deep groove portion of another string groove has a peak, which is closer to the bottom side than the axis line in top view.

2. The bridge for the string instrument according to claim 1, wherein the number of the deep groove portions of each string groove is two in the vertical cross section, and the peaks of the chevron shapes are symmetrically arranged with respect to a straight line in the direction from the upper side to the bottom side.

3. The bridge for the string instrument according to claim 2, wherein each string groove has a uniform portion with a constant depth, the two deep groove portions extend from the uniform portion and communicate with each other at a position that has the same depth as that of the uniform portion.

4. The bridge for the string instrument according to claim 3, wherein each saddle has a diameter of 7 to 10 mm, and the deep groove portions have a curvature radius of 5 to 8 mm.

5. A string instrument having six strings and having the bridge recited in claim 2, formed so as to be changeable from a right-handed structure to a left-handed structure such that a saddle for first and second strings is arranged at a position of a saddle for fifth and sixth strings by being turned upside down, the saddle for the fifth and sixth strings is arranged at a position of the saddle for the first and second strings by being turned upside down, and a saddle for third and fourth strings is arranged at the same position by being turned upside down.

6. A string instrument having four strings and having the bridge recited in claim 2, formed so as to be changeable from a right-handed structure to a left-handed structure such that a saddle for first and second strings is arranged at a position of a saddle for third and fourth strings by being turned upside down, and the saddle for the third and fourth strings is arranged at a position of the saddle for the first and second strings by being turned upside down.

7. A saddle for a string instrument, comprising:

a saddle body having an approximately columnar shape and having a center portion and two ends;

string grooves extending along a circumferential direction at an outer circumference of the two ends of the saddle body;

a position adjustment screw hole provided at the center portion of the saddle body and orthogonally crossing an axis line of the saddle body; and height adjustment screw holes provided by passing through the two ends of the saddle body, respectively, and the height adjustment screw holes crossing the position adjustment screw hole in side view, and wherein each of the string grooves has deep groove portions, each of the deep groove portions has an approximately arc shape in cross section and has a larger curvature radius than that of the string groove in vertical cross section, whereby each of the deep groove portions has a chevron shape in the vicinity of a starting point thereof in vertical cross section, the chevron shapes of the deep groove portions are arranged in a direction in which a height adjustment screw hole passes through, the chevron shape of a deep groove portion of one of the string grooves has a peak and the chevron shape of another deep groove portion of another string groove has a peak, and the peaks are arranged at different positions in the circumferential direction.

* * * * *